United States Patent [19]

Garier et al.

[11] 4,274,849

[45] Jun. 23, 1981

[54] METHOD AND PLANT FOR LIQUEFYING A GAS WITH LOW BOILING TEMPERATURE

[75] Inventors: Christian Garier; Henri Paradowski, both of Rueil-Malmaison, France

[73] Assignee: Campagnie Francaise d'Etudes et de Construction Technip, Paris, France

[21] Appl. No.: 68,430

[22] Filed: Aug. 21, 1979

Related U.S. Application Data

[63] Continuation of Ser. No. 941,925, Sep. 13, 1978, abandoned, which is a continuation of Ser. No. 775,273, Mar. 7, 1977, abandoned, which is a continuation of Ser. No. 626,107, Oct. 28, 1975, abandoned.

[30] Foreign Application Priority Data

Nov. 21, 1974 [FR] France ..... 74 38312

[51] Int. Cl.[3] ..... F25J 1/02

[52] U.S. Cl. ..... 62/9; 62/38; 62/40; 62/335

[58] Field of Search ..... 62/9, 40, 38, 335

[56] References Cited

U.S. PATENT DOCUMENTS 3,964,891 6/1976 Krieger ..... 62/40

FOREIGN PATENT DOCUMENTS 110556 2/1961 Pakistan ..... 62/40

*Primary Examiner*—Norman Yudkoff

*Attorney, Agent, or Firm*—Kenyon & Kenyon

[57] ABSTRACT

Method of liquefying a mixture of gas rich in methane by performing an auxiliary cycle and a main cycle in which are used an auxiliary and a main refrigerating fluid of several components. In each cycle are performed the compression, cooling, liquefying and sub-cooling of the refrigerating fluids in counter-flowing relationship with themselves after expansion-vaporization in a heat exchanger. The gas to be liquefied is cooled in parallel with said main refrigerating fluid which has been pre-cooled in the auxiliary cycle. Pre-cooling of said gas is performed in an exchanger cooled by the refrigerating main fluid after its expansion-vaporization in said heat exchanging column of said main cycle and before its re-compression.

45 Claims, 7 Drawing Figures

Figure 1:
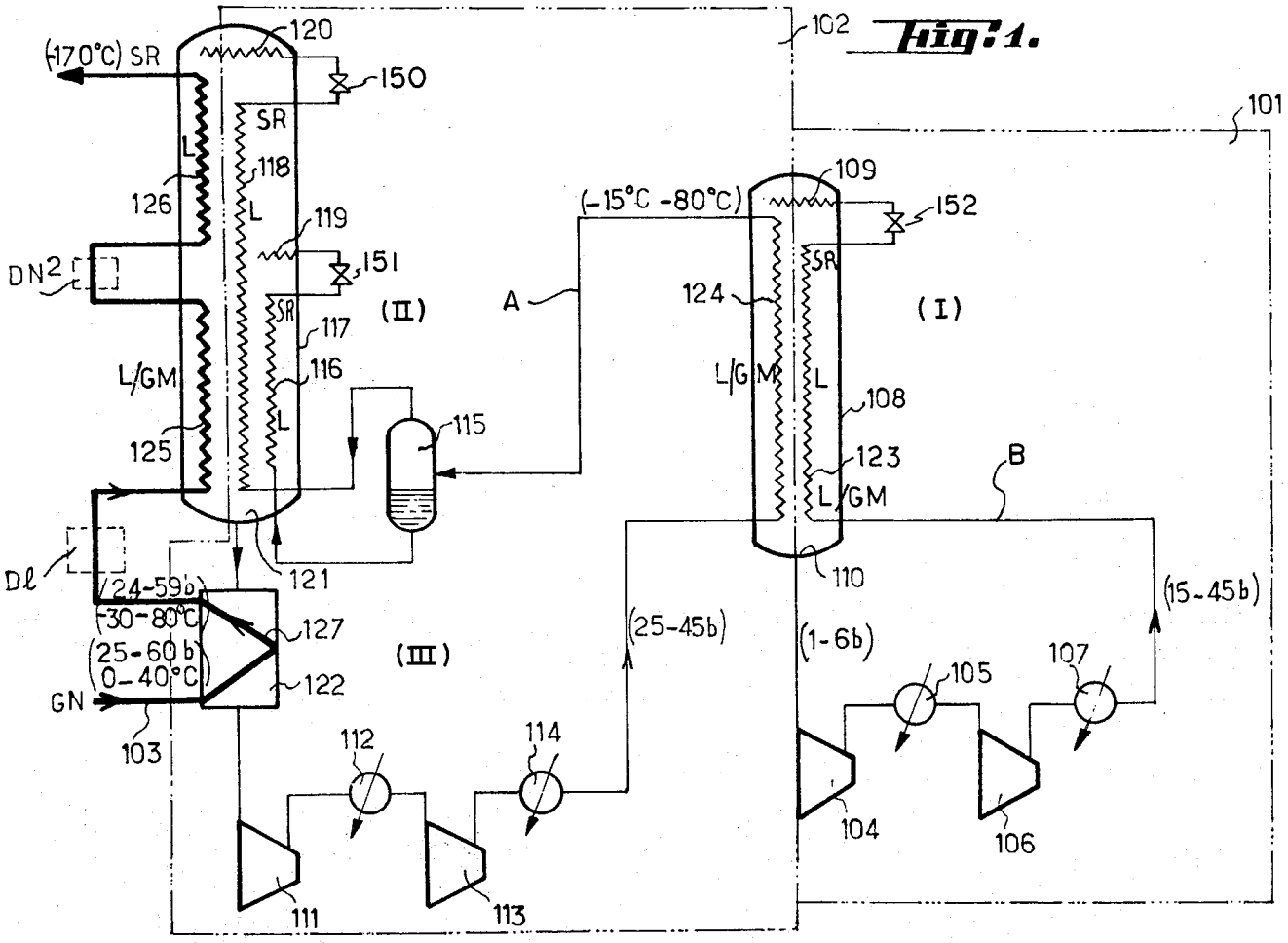

-15°C-80°C
A
B
L/GM
(I)
(II_B)
(II_A)
(III)
SR
L
G
DN2
Dℓ
GN
303
304
305
306
307
308
309
310
311
312
313
314
322
323
324
325
327
331
332
333
334
335
350
352

550
523
535(IIB)
532
526
DN2
519
551
534
(IIA)
516
531
525
544
553
539
(IV)
541
540
542
(-15°C-80°C)
A
509
552
508(I)
B
(15-45b)
537
(V)
GN
527
522
(III)
Dl
507
506
505
504
(25-45b)
514
513
512
511

707
706
705
704
(15-45b)
752
708 (I)
709
723
B
710
SR
724
15°C-80°C
A
L/GM
715
753
(25-45b)
714
713
741
740
739
(IV)
742
737(V)
GN
744
L/GM
738
743
750
733
735(IIB)
732
751
719
734
(IIA)
716
712
SR
L
726
731
L/GM
725
G
DN2
FH
727
722
(III)
711
Dl
Rl

METHOD AND PLANT FOR LIQUEFYING A GAS WITH LOW BOILING TEMPERATURE

This application is a continuation of application Ser. No. 941,925 filed Sept. 13, 1978, now abandoned, which was a continuation of application Ser. No. 775,273 filed Mar. 7, 1977, now abandoned, which in turn was a continuation of application Ser. No. 626,107 filed Oct. 28, 1975, now abandoned.

The present invention relates to the liquefaction of a gas with low boiling temperature such as for instance natural gas (NG) having a high content of methane or any other mixture of gases to be liquefied including at least one component with a low boiling temperature.

The method of liquefaction forming the subject matter of the present invention is of the kind consisting in performing a heat exchange in counter-flowing relationship with a refrigerating fluid (RF) having several components, said fluid being used in a working cycle comprising at least one compression followed by a pre-cooling operating step bringing it for its major part to the liquid state and then an expansion-vaporizing step in a column or the like in counter-flowing relationship with itself in order to sub-cool same in the liquid condition, the vaporized expanded fluid being then recycled undergo said compression.

There are known processes of liquefaction for instance of a natural gas wherein the natural gas is gradually liquefied in heat exchanging relationship successively with several refrigerating fluids having decreasing boiling points. Such a so-called "cascade" process requires the use of a great member of exchangers, compressors, pumps and so on to provide for the flow in a closed circuit of each one of the refrigerating fluids. The plant is therefore complicated and the multiplicity of the equipments decreases the reliability or dependability of the whole arrangement. Moreover, the cooling curves for these refrigerating fluids do not follow the continuous trend of the cooling curve of the natural gas thereby resulting in a fall in the efficiencies or yields and accordingly in substantial power losses.

There are also known methods of liquefaction of a natural gas in heat-exchanging relationship with a refrigerating fluid having several components and undergoing at least one partial condensation, the condensed part of said refrigerating fluid providing through heat-exchange the liquefaction of the natural gas. The condensed part or parts of said refrigerating fluid also form a refrigerating fluid with several components. The cooling curve of the refrigerating fluid having several components or multiple components (MCF) is in the present instance close to the cooling curve of the natural gas. Moreover, the plant is simplified only requiring one singlecompressor set since there is one single (complex) refrigerating fluid only available in the plant. The plant requires, however, the use of exchangers and exchanging columns of large sizes and, as generally several partial condensations are anticipated, a high number of separating drums (separators) for the liquid and vapor phases of said refrigerating fluid.

It is also known to make use of an auxiliary refrigerating fluid with several components for simultaneously pre-cooling in a common heat exchanger (or in a common exchanging column) the natural gas to be liquefied and the main refrigerating fluid. The auxiliary and main refrigerating fluids flowing each one in a closed circuit are each compressed in a distinct compressor set. Unfortunately, the use of this known method requires the presence of two low pressure essentially gaseous fluids, namely both refrigerating fluids in a single common exchanger thereby involving very large separated passageway cross-sections for these two fluids and practically precluding the use of a coiled-type exchanger, i.e. comprising exchanging coils.

The object of the present invention is to avoid the afore-mentioned inconveniences of the prior art by providing a method of liquefying a gas having a low boiling point such as for instance natural gas rich in methane wherein there is carried out a heat exchange in counter-flowing relationship with a refrigerating fluid having several components, said fluid being used in a working cycle including at least on compression followed by a pre-cooling step bringing it for its major portion to the liquid state and then an expansion-vaporizing step in an exchanging column or the like in counter-flowing relationship with itself in order to sub-cool same in the liquid condition, the expanded vaporized fluid being then recycled to undergo said compression. This method is characterized according to the invention by the steps of using at least two staged aforesaid refrigerating fluid cycles, namely an auxiliary cycle pre-cooled by any suitable outer source comprising for instance a water exchanger, and a main cycle pre-cooled within said exchanging column or the like for the expansion-vaporization and sub-cooling of the auxiliary cycle, and using said main cycle for performing the refrigeration-liquefaction of said gas with a refrigerating fluid of said main cycle by causing said refrigerating fluid to flow successively through said exchanging column or the like for the expansion-vaporization of said main cycle, and a heat exchanger bathed in or washed round on the fluid side by said main expanded refrigerating fluid issuing in the gaseous state from said column or the like and flowing towards the compression stage of said main cycle, and causing said gas to flow in counter-current relationship with said refrigerating fluid successively through said exchanger where it is pre-cooled and said exchanging column or the like where it is successively liquefied and then sub-cooled.

Such a method offers a great number of advantages among which the following may be stated:

It exhibits a high flexibility and will adapt itself to very different operating conditions while retaining a high thermodynamic efficiency; such a flexibility is shown in particular in the obtaining of the various sub-cooling temperatures of said gaseous mixture by for instance varying in the refrigerating fluid of the main circuit the content in the most volatile component (more volatile than methane) as will be specified later on.

It may easily be adapted to the liquefaction of mixtures or blends of various gases and in particular of natural gases having very differing compositions.

The cycle of pre-cooling the main refrigerating fluid, i.e. the fluid flowing in the main cycle, by a second auxiliary refrigerating fluid flowing in the auxiliary refrigerating cycle may be used in combination with various cycles of liquefying said gaseous mixture in heat exchanging relationship with the main refrigerating fluid.

The exchanging columns and other heat exchangers used have relatively small sizes.

The whole plant is comparatively simple since only a limited number of exchanging columns, exchangers or the like of simple hence cheap construction are used; in this connection it is possible to use any kind of known exchangers and in particular plate-type exchangers and coiled exchangers as referred to later on.

Axial-flow or centrifugal compressors may be used for carrying out the compressions of the refrigerating fluids.

As mentioned hereinabove the sensible heat of the vaporized main refrigerating fluid is used for pre-cooling the gas by said fluid. This makes it possible to achieve an improvement in the thermodynamic efficiency of the whole arrangement and avoids the requirement of using special and expensive materials for building the compressors as this would be the case if the suction or drawing in of the main fluid were performed at low temperature.

The suction or inlet temperature of the compressors is within the scope of the invention definitely different from the dewpoint temperature of the refrigerating fluid thereby making it possible to remove any possibility of carrying along liquid particles into the compressor.

As to the components of the main and auxiliary refrigerating fluids, they generally may be at least partially extracted from the mixture of gases to be liquefied for instance from the natural gas. The composition of each one of these main and auxiliary refrigerating fluids may be determined and adjusted according to the composition of the gas which is desired to be liquefied. The compositions of the refrigerating gases are usually not critical and may vary within some limits. Additions of make-up fluids with a view to compenste for the losses of refrigerating fluid in each main and auxiliary working cycle do not require to be thoroughly purified as this would be indispensable if either of the refrigerating fluids used had consisted of a single component.

Usually the main refrigerating fluid comprises at least two hydrocarbons preferably containing $C_1$ (methane) and $C_2$ (ethane, ethylene) and of a substance having a boiling point substantially lower than that of the $C_1$ (methane)-based hydrocarbon. The second auxiliary refrigerating fluid comprises at least two components selected from $C_1$, $C_2$, $C_3$ or $C_4$-based hydrocarbons; the percentages of each component in each one of said refrigerating fluids will depend upon the desired pre-cooling temperature for the main refrigerating fluid when leaving the exchanging column of the auxiliary working cycle. This composition also depends upon the outer precooling system used for the second auxiliary refrigerating fluid, air exchanger, water exchanger and so on.

The pre-cooling temperature of the main refrigerating fluid will of course be generally selected essentially according to the composition of the gas which is desired to be liquefied.

According to a preferred form of embodiment said auxiliary refrigerating cycle makes use of one single exchanging column where the auxiliary fluid is expanded and vaporized in counter-flowing relationship with itself for sub-cooling same and where the main refrigerating fluid is pre-cooled. It should be noted that it is possible to have said auxiliary refrigerating cycle work or operate with any outer exchanging course providing for the pre-cooling of said auxiliary fluid at temperatures which may vary widely according to local conditions. For instance the pre-cooling of the auxiliary fluid may be carried out within water exchangers, air exchangers and so on according to the local layout. In every case the composition of said auxiliary fluid will be adjusted according to these pre-cooling requirements.

Such an adjustment will not exert any influence upon the pre-cooling of the main refrigerating fluid the extent of which, all things being equal, will be determined by the nature of the most volatile components forming the auxiliary refrigerating fluid.

In other words when the method according to the invention is used there is achieved an independence of operation of the main refrigerating cycle and of the auxiliary refrigerating cycle. This would still increase the flexibility of the method and makes it possible to increase the efficiency through simple suitable adjustment of the various parameters involved: chains of temperatures and pressures in each auxiliary and main cycle, natures of the components of the main refrigerating fluid and of the auxiliary refrigerating fluid, etc. The only mutual links or interconnection left between the pre-cooling cycle for the main refrigerating fluid and the cooling cycle for the gas to be liquefied are carried out at high pressure and would affect the main refrigerating fluid before and after precooling thereof thereby making it possible to separately lay out pre-cooling systems for the main fluid and those for liquefying the gas and therefore making it possible to reduce the spacings between the compressor sets and the main heat exchangers of each one of such plants while reducing the head or pressure losses in particular on the suction side of each compressor set and enhancing the thermodynamic efficiency of the whole arrangement.

The invention is moreover directed to plants built according to the method of the invention and making it possible to carry same out.

The invention will appear more clearly and further objects, characterizing features, details and advantages thereof will appear more clearly as the following explanatory description proceeds with reference to the accompanying diagrammatic drawings given by way of non-limiting examples only illustrating specific presently preferred forms of embodiment of the invention, and wherein FIGS. 1 to 7 show a number of forms of embodiments designed according to the invention.

The form of embodiment shown in FIG. 1 should at first be referred to. In this Figure the essential elements of the plant are designated by reference numerals comprised between 100 and 199; in order to avoid repetitions in the description of the other Figures similar elements used in the various plants will be denoted by the same reference numerals only the hundreds thereof being changed to be those of the Figure. Moreover, in the diagrams it should be assumed by convention that ducts communicate with each other only if at their crossing points a dot has been marked, whereas ducts are crossing without being connected to each other if no dot has been shown in the drawing at the point of intersection.

The form of embodiment shown in FIG. 1 will now be described.

The plant essentially comprises an auxiliary refrigerating cycle framed at 101 and a main refrigerating cycle framed at 102 making it possible to perform the liquefaction of a gas having a low boiling point such for instance as natural gas (NG) the circuit of which appears in thick solid lines at 103 in the drawing.

The auxiliary cycle makes essentially use of a first refrigerating fluid (B) flowing in a closed loop comprising the compressor 104, the cooler 105, a second compressor or second compression stage 106 and a second cooler 107 connected in series. The auxiliary refrigerating fluid with multiple components (B) or (MCF) used is fed as a liquid phase or as a composite phase, i.e. mixed liquid and gas (L/GM) at the bottom of the exchanging column 103 or (I) where it is gradually converted fully into a liquid phase (L) to be sub-cooled (SR) at the top of the column through the effect of its being expanded in expansion valve 152 and disbributed at the top of the column as shown at 109 and vaporized in counter-flowing relationship with itself. The expanded and vaporized auxiliary refrigerating fluid is drawn in at the bottom 110 of the column 108 at the inlet of the compressor 104.

The auxiliary cycle thus described is of a kind known per se and as set forth hereinabove the composition of the refrigerating fluid with several components (A) or (MCF) used will vary according to the operating and layout requirements.

The main cycle 102 makes use of a main refrigerating fluid with multiple components (A) or (MCF) the composition of which will be selected as set forth hereinabove so as to provide for the liquefaction of the natural gas fed into the station, and for this purpose it will comprise at least one component more volatile than the most volatile main component of the natural gas to be liquefied such for instance as methane in the case of a natural gas. These other components and their relative amounts within the mixture will be selected according to the pre-cooling temperature of the main refrigerating fluid and to the composition and pressure of the natural gas.

In the example shown the main refrigerating fluid (A) successively flows through a compressor 111, a cooler 112, a second compressor or second compression stage 113 and a second cooler 114. As in the case of the auxiliary cycle the compressors 111, 113, 104, 106 may be of any known type as well as the coolers (112, 114, 105, 107) using for instance water, air, etc. as a coolant.

When flowing out of the cooler 114 the main refrigerating fluid with multiple components (MCF) is pre-cooled and liquefied partially in the exchanging column 108 in counter-flowing relationship with the expanded and vaporized auxiliary refrigerating fluid in this column. When leaving the column 108 the mixture of main refrigerating gas consists therefore of a composite phase of liquid and gas (L/GM). The exchanging column 108 may be of any known suitable type and the pipe-lines which extend therethrough may in particular be coiled as diagrammatically shown.

When leaving the column 108, the main refrigerating fluid is separated within a separator 115 into a liquid phase which is fed into a coiled portion 116 at the bottom of an exchanging column 117 or (II), and into a gaseous phase containing the most volatile components and which is allowed to flow throughout the column 117 within a coil 118 opening at the top of the column. The refrigerating fluid will undergo at each end of the coils 116 and 118 an expansionvaporization step in counter-flowing relationship with itself as diagrammatically shown at 151, 119; 150, 120 thereby enabling the liquefaction and sub-cooling of both portions of the refrigerating fluid within the respective coils 116 and 118 to take place.

The main fluid expanded and vaporized within the column 117 is collected or recovered at the bottom 121 of the column and is passed into an exchanger 122 or (III) which will advantageously be of the multiple-plate type. After having left the exchanger 122 the fully gaseous main refrigerating fluid is fed into a compressor 111.

As to the natural gas (NG) circulating along the path of travel shown at 103 it will successively flow through the multiple-plate exchanger 122 where it will undergo a pre-cooling step while exchanging its heat with the sensible heat of the expanded and vaporized main refrigerating fluid and then it will gradually be fully liquefied step by step to issue in a sub-cooled condition from the top of the column 117.

Between the exchanger 122 and the column 117 the natural gas may possibly undergo a purifying step in order to extract the heavy parts from the gas as diagrammatically illustrated by the rectangular block shown at D1. Likewise, after having travelled over some distance within the exchanging column 117, it is possible to have the partially liquefied natural gas denitrogenized as diagrammatically shown by the rectangular block designated by $DN^2$.

The exchanging column 117 may be designed rather like the column 108 and the coiled construction diagrammatically illustrated would be quite adequate.

In order to facilitate the reading of the drawing the coiled running path of travel of the auxiliary fluid within the exchanging column 108 has been designated by the reference numeral 123; the coiled running path of travel of the main fluid within the column 108 has been denoted by the reference numeral 124; the coiled running paths of travel of the natural gas within the column 117 has been denoted by the reference numerals 125 and 126 whereas the path of travel of the natural gas within the multiple-plate exchanger 122 has been designated by the reference numeral 127.

Moreover, the following various symbols with their meanings given hereinbelow have been used at various locations in the drawings:

L=liquid
G=gas
NG=natural gas
RF=refrigerating fluid
MCF=refrigerating fluid with multiple components
L/GM=liquid-gas mixture
SR=sub-cooled liquid.

The plant arrangement described hereinabove provides the association of an auxiliary pre-cooling cycle 101 of very simple construction and very flexible use taking into account the possibility of adapting the composition of the auxiliary refrigerating fluid with several components, a main refrigerating cycle with a single pressure and also of very simple use and operation. The thermodynamic efficiency of the unit is outstanding because the efficiencies are so at every level, i.e. at that of the pre-cooling of the main refrigerating fluid within the column 108, at that of the pre-cooling of the natural gas within the multiple-plate exchanger 122 in exchanging relationship with the sensible heat of the expanded and vaporized main refrigerating fluid, and at last at that of the liquefaction and sub-cooling of the natural gas within the column 117.

This cycle will very well adapt itself to a denitrogenization through distillation of a natural gas with a high nitrogen content as well as to a thorough extraction of the heavy components for instance of those containing $C_3$ and $C_4+$ from the natural gas.

Moreover, it is possible to achieve a very substantial subcooling of the liquefied natural gas (LNG) for instance down to a temperature lower than −170° C.

Table I given hereinafter shows the composition of the main refrigerating fluid according to its pre-cooling temperature within the exchanging column 108.

TABLE I

| Composition of the main refrigerating fluid according to the pre-cooling temperature | | | | |
|---|---|---|---|---|
| T °C. | −75 | −55 | −30 | −15 |
| $N^2$ % | 10–20 | 6–10 | 4–10 | 4–10 |
| $C_1$ | 30–40 | 30–55 | 30–55 | 25–40 |
| $C_2$ | 30–50 | 30–55 | 40–60 | 45–65 |
| $C_3$+ | 0–10 | 0–15 | 0–15 | 0–15 |
| M.W. of the HC | 20–25 | 20–25 | 20–26 | 22–23 |
| D.P. of compressor | ←25–45 effective bars→ | | | |

At the bottom of the table have been stated the molecular weight (M.W.) of the hydrocarbons (HC) contained in the main refrigerating fluid and also the delivery pressure (D.P.) from the compressor (at the discharge side or output of the compressor 113) which is given in effective bars, that is the gauge or relative pressure above atmospheric pressure.

In Table II given hereinafter has been likewise stated the composition of the auxiliary refrigerating fluid according to the pre-cooling temperature of the main refrigerating fluid.

Moreover, at the bottom of this table have been stated the molecular weight (M.W.) of the auxiliary refrigerating fluid, the delivery pressure (D.P.) at the outlet of the compressor (discharge side or output of compressor 106) measured in effective bars and also the suction pressure (S.P.) at the intake of the compressors (that is at the suction side or input of compressor 104). There has also been stated the suction temperature (S.T.) at the suction side of the compressors (at the inlet of compressor 104).

At the bottom of the table there has been stated the percentage of liquefaction of the refrigerating fluid at the inlet of the column 108.

TABLE II

| Composition of the auxiliary refrigerating fluid according to the pre-cooling temperature of the main refrigerating fluid. | | | | |
|---|---|---|---|---|
| T °C. | −75 | −55 | −30 | −15 |
| $C_1$ | 20–40 | 0–15 | — | — |
| $C_2$ | 20–50 | 30–60 | 20–50 | 0–10 |
| $C_3$ | 10–30 | 10–40 | 20–50 | 30–60 |
| $C_4$+ | 10–25 | 10–30 | 10–30 | 10–40 |
| M.W. | 30–37 | 34–41 | 38–45 | 41–49 |
| D.P. of compressor (eff. bars) | 35–45 | 30–45 | 20–30 | 15–25 |
| S.P. of compressor (eff. bars) | 1–3 | 1–4 | 1.5–5 | 2–6 |
| S.T. of compressor | ←0–35° C.→ | | | |
| Conditions at input of column | >60% L* | >80% L* | L | L |

*>60% L and, >80% L respectively mean that at least 60% refrigerating fluid are liquefied at the inlet of column 108.

Moreover, in the drawing have been shown some essential data corresponding in particular to the input conditions of the natural gas into the plant: pressure from 25 to 60 bars, temperature from 0° C. to 40° C.; to the conditions of the natural gas at the outlet of the multiple-plate exchanger 122: pressure from 24 to 59 bars, temperature from −30° C. to −80° C. These conditions would correspond to a natural gas having the following approximate composition: 0% to 15% of $N_2$, 60% to 100% of $C_1$, 0% to 20% of $C_2$, 0% to 10% of $C_3$+.

Figure 2:
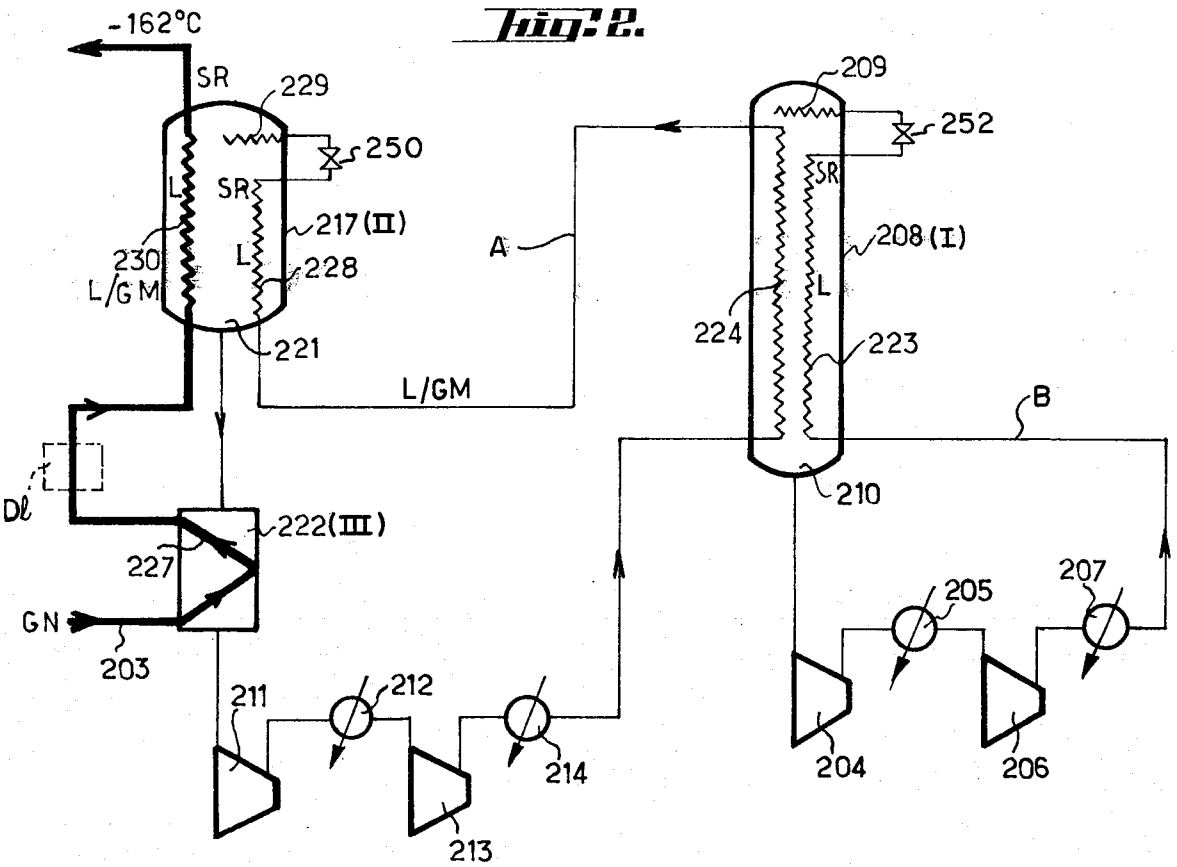

Reference should now be had to the alternative embodiment shown in FIG. 2. In this diagram are found again a great number of the component elements shown in FIG. 1 which have been designated according to the conventions defined hereinabove by the same reference numerals increased by 100 units.

The plant depicted in FIG. 2 differs from that of FIG. 1 essentially in that the exchanging column 217 or (II) for liquefying the natural gas is fitted with one single coil 228 extending therethrough and conveying the main refrigerating liquid (A) consisting of a mixed liquid-gaseous phase without any previous separation in a separator such as 115 shown in FIG. 1 of the liquid phase from the vapor phase of the refrigerating fluid. The refrigerating liquid is sub-cooled at the head or top of the column through expansion-vaporization as shown at 250, 229 and flow of its expanded phase in counter-current relationship with itself.

In the examplary embodiment illustrated it has been assumed, moreover, that the natural gas did not undergo the denitrogenization provided for in FIG. 1 and was therefore subjected within a single coil 230 to a gradual conversion of a liquid-gas mixture into liquid (L) and then into sub-cooled liquid (SR) at the egress from column 217.

This arrangement is fairly well applicable in the case of a natural gas lean in nitrogen and which has not to undergo any thorough sub-cooling step, an outlet temperature of −162° C. being usually contemplated. This arrangement is also applicable in a process of denitrogenizing liquefied natural gas through final flash vaporization.

Figure 3:
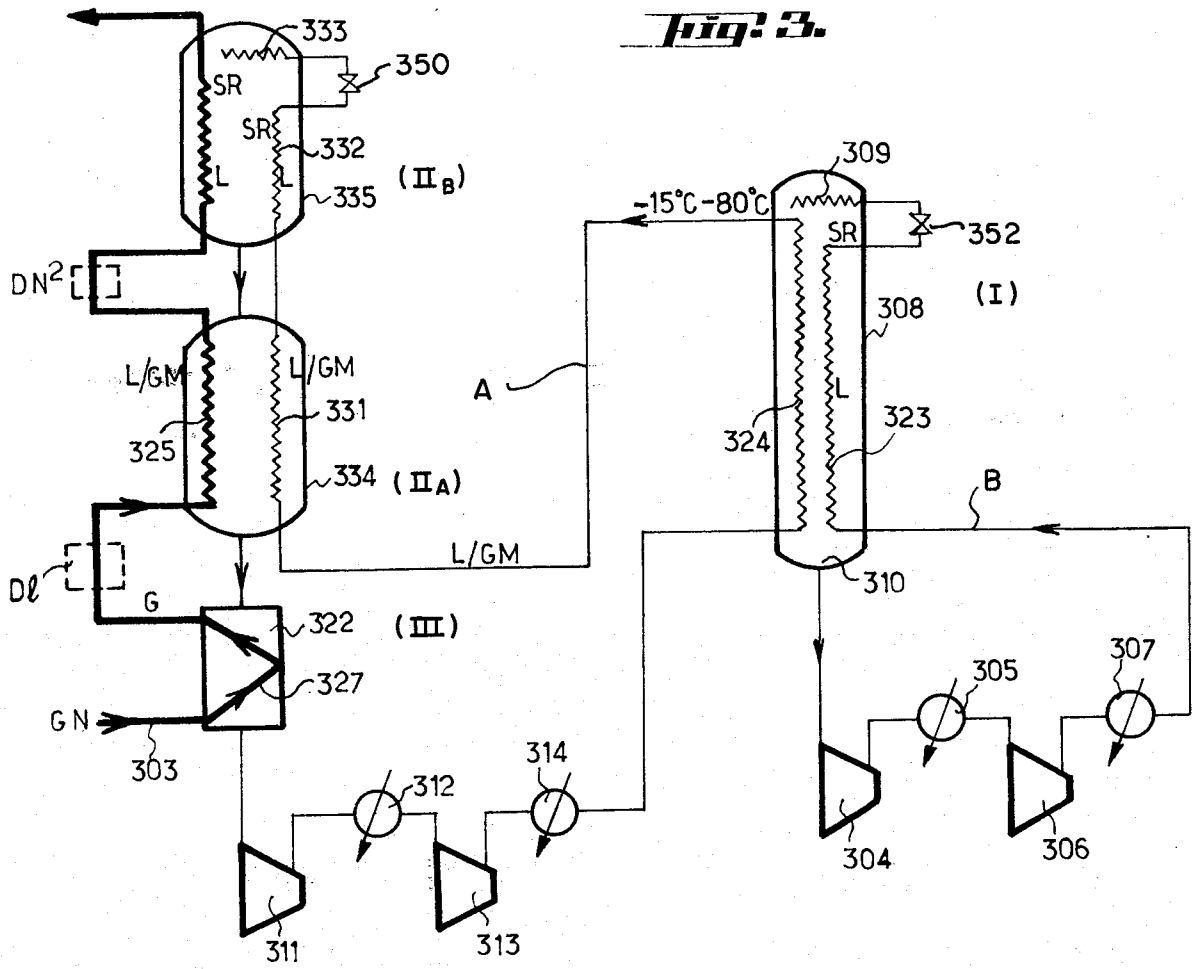

According to the alternative embodiment shown in FIG. 3 the main refrigerating fluid (A) pre-cooled at the outlet of the exchanging column 308 or (I) is fed without any separation between its liquid and vapor phases into two exchanging columns 334, 335 or ($II_A$), ($II_B$). At the head or top of the column 335 the refrigerating fluid is undergoing an expansion and vaporizaton as diagrammatically shown at 350 and 333 making it possible to sub-cool and fully liquefy same within the column 335 and at least partly liquefy it in the column 334. This liquefaction is due to the circulation in counter-flowing relationship with the refrigerating fluid flowing through the coils 331 and 332 of the refrigerating fluid expanded at 333 and flowing successively through the exchanging columns 335 and 334 towards the exchanger 322 or (III) and the suction inlet of the compressor 311. It should be noted that both columns 334, 335 could be re-arranged as a larger and substantially equivalent single column.

The natural gas is in turn pre-cooled in the multiple-plate exchanger 322 and then it may become rid of its heavy components as is shown at D1, and afterwards it will undergo a cooling and a partial liquefaction in the column 334, and subsequently it may be subjected to a denitrogenization as shown at $DN^2$ for being eventually liquefied and sub-cooled in the column 335.

The diagram in FIG. 3 is very well adaptable in particular to natural gases with high nitrogen contents which have to be denitrogenized through distillation and for which should be carried out a thorough extraction of heavy substances in particular $C_3$ and $C_4$+ therefrom and for which a substantial sub-cooling temperature is not desired.

It should now be referred to the alternative embodiment shown in FIG. 4 wherein are found again for their major part the elements already depicted in the foregoing figures and wherein are moreover found other elements which have been inserted essentially into the main refrigeration cycle. These elements have been added so as to use to a greater extent in the main refrigeration cycle the effects of the temperature cascades tied to successive flows through separator drums of the main multiple-component refrigerating fluid (A) working under a single pressure and used in this cycle. Moreover advantage is taken from both compression stages of the main cycle with a view to re-cycle a heavier part of the main refrigerating fluid directly to the suction side of the second compression stage.

Referring to FIG. 4 there is found again at 408 the exchanging column (I) of the auxiliary cycle providing within the coil 424 for the pre-cooling of the main refrigerating fluid (A). At the output of this column the main refrigerating fluid (A) or (MCF) is sub-cooled down to temperatures of about from −15° C. to −80° C. under an effective pressure ranging from about 25 bars to 45 bars without taking into account the head or pressure loss in the coil 424. As stated hereinabove the main refrigerating fluid (A) then exhibits a mixed liquid-gaseous phase. It is then subjected to a separation in a separator 415. The liquid phase is carried back to a column 439 (IV) where after having flown through a coil 440 it is expanded and vaporized as shown at 453, 441 and recovered or collected at the bottom 442 of the column 439 with a view to be recycled after having flown through an exchanger advantageously of the multiple-plate type 437 or (V) at the input of the second compression stage 413. Upon flowing through the colunm 408 the liquid phase is recovered or collected in the separator drum 415, vaporized and expanded in the column 439 which performs the sub-cooling of this liquid phase in counter-flowing relationship with itself.

The vapor phase separated in the separator 415 is conveyed into a coil 443 of the column 439 where it is partially liquefied owing to the expansion-vaporization of the liquid phase recovered and collected in the separator 415, sub-cooled and then expanded at 441.

The mixed liquid-gaseous phases are recovered or collected at the egress from the coil 443 in a further separator 444. The liquid phase containing the less volatile components is carried to an exchanging column 434 or ($II_A$) where it is sub-cooled in counter-flowing relationship with itself and vaporized at 419.

The gaseous phase issuing from the separator 444 holding the most volatile components of the main refrigerating fluid (A) is at first cooled in the coil 431 of the column 434 where it is partially liquefied and afterwards it is fed into the column 435 or $II_B$ where it is liquefied and sub-cooled in counter-flowing relationship with itself, expanded and vaporized at 450, 433.

The expanded and vaporized parts of the main refrigerating fluid (A) in the columns 435 and 434 are carried back to the intake of the compressor 411 after having flown through the multiple-plate exchanger 422 or (III).

As to the natural gas, the latter is pre-cooled within the multiple-plate exchanger 437 or (V) in exchanging relationship with the sensible heat of the heaviest fraction of the main refrigerating fluid (A) vaporized and expanded in the column 439 or (IV) and then the natural gas will undergo a second pre-cooling step in the multiple-plate exchanger 422 in exchanging relationship with the sensible heat of the other portion of the expanded and vaporized main refrigerating fluid (A) successively recovered or collected in the columns 435 and 434. At the egress from the exchanger 422 and after a possible purification of the heavy fractions as shown at D1, the natural gas is partially liquefied in the exchanging column 434. After having flown through the column 434 and possibly undergone a denitrogenization as shown at $DN^2$ the natural gas is liquefied and then sub-cooled in the exchanging column 435. It should be pointed out that both columns 434, 435 could be re-arranged as one single column having two cooling and expansion-vaporization levels as shown in FIG. 1 in relation to the column 117 where the coil 118 corresponds substantially to both coils 431, 432 connected in series of the form of the embodiment illustrated in FIG. 4 and where the expansion-vaporization system 120 corresponds substantially to the system 433.

In the arrangement described it will be found that the natural gas is undergoing two successive pre-cooling steps in the multiple-plate exchangers 437, 422 thereby making it possible to use under the best thermodynamical conditions the sensible heat of the main refrigerating fluid (A) expanded under two staged pressures corresponding to two also staged composition sections.

Figure 4:
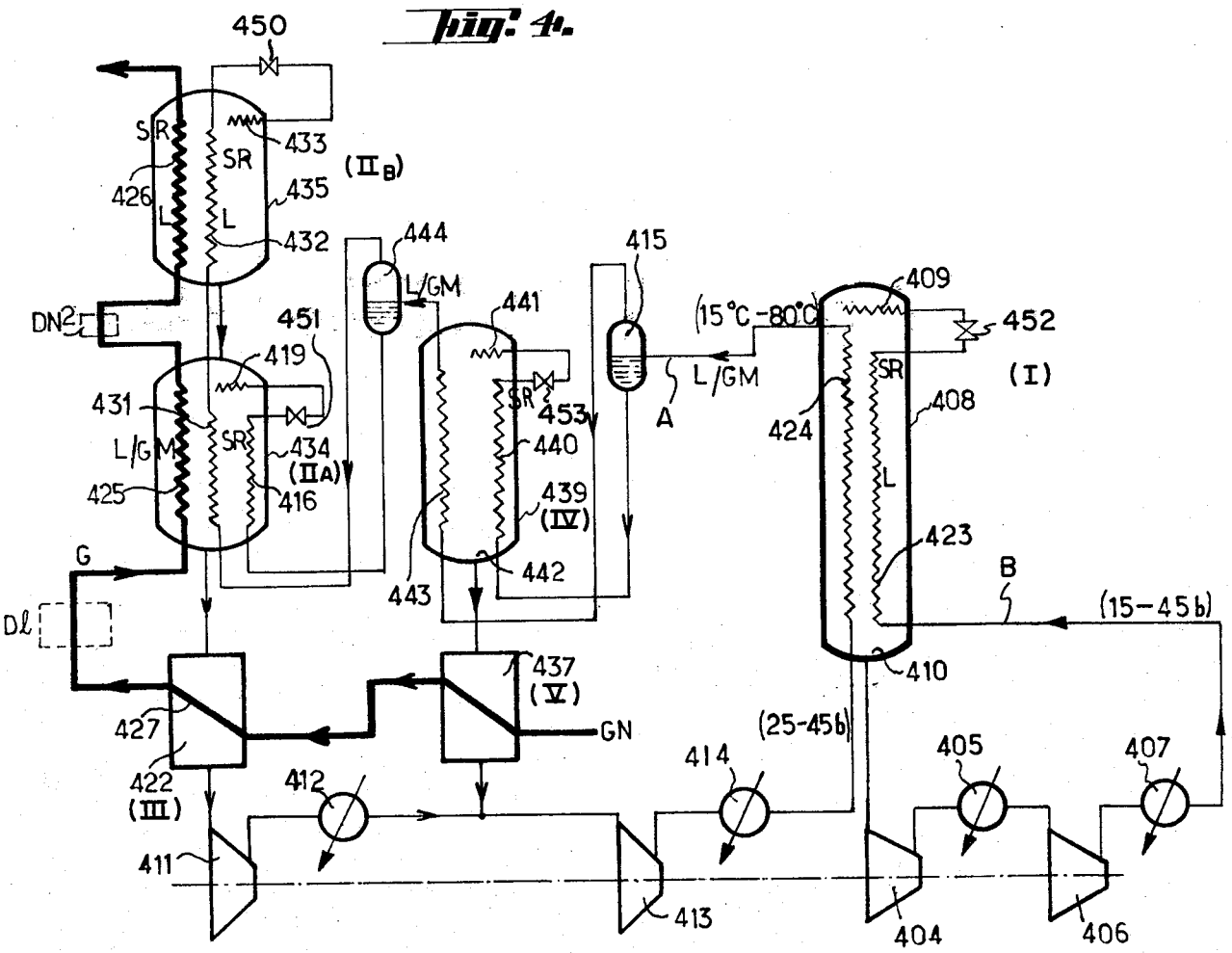

According to another modification, not shown, it is possible to subject the natural gas to a pre-cooling step by causing it to flow prior to its ingress into the column 434 through the exchangers 437 and 422 which are no longer mounted in series as shown in FIG. 4 but in parallel relationship (as in FIG. 6) the flow rates of natural gas through each exchanger 437, 422 being adjusted according to the cooling capacity of each exchanger 437, 422.

The cycle illustrated in FIG. 4 makes it possible in particular to reduce the volumetric flow rates at low pressure owing to the partial re-cycling of the heavy fraction between both compression stages 411, 413 of the main refrigerating fluid (A). It makes it possible proportionally reduce the sizes of the compressors used.

Moreover, it makes it possible to increase the efficiency of the thermodynamical cycle by reducing the irreversibilities in connection with the temperature differences between the cooled and cooling fluids in particular at the exchanging columns 439, 434 and 435.

This cycle also makes it possible to work with relatively high pre-cooling temperatures at the exchangers 405, 407 without any significant drawback. In particular, such a cycle may be adapted in the case where no water coolant is available and where an air coolant has to be used.

This arrangement is also very well adaptable to the use of axial-flow compressors.

Figure 5:
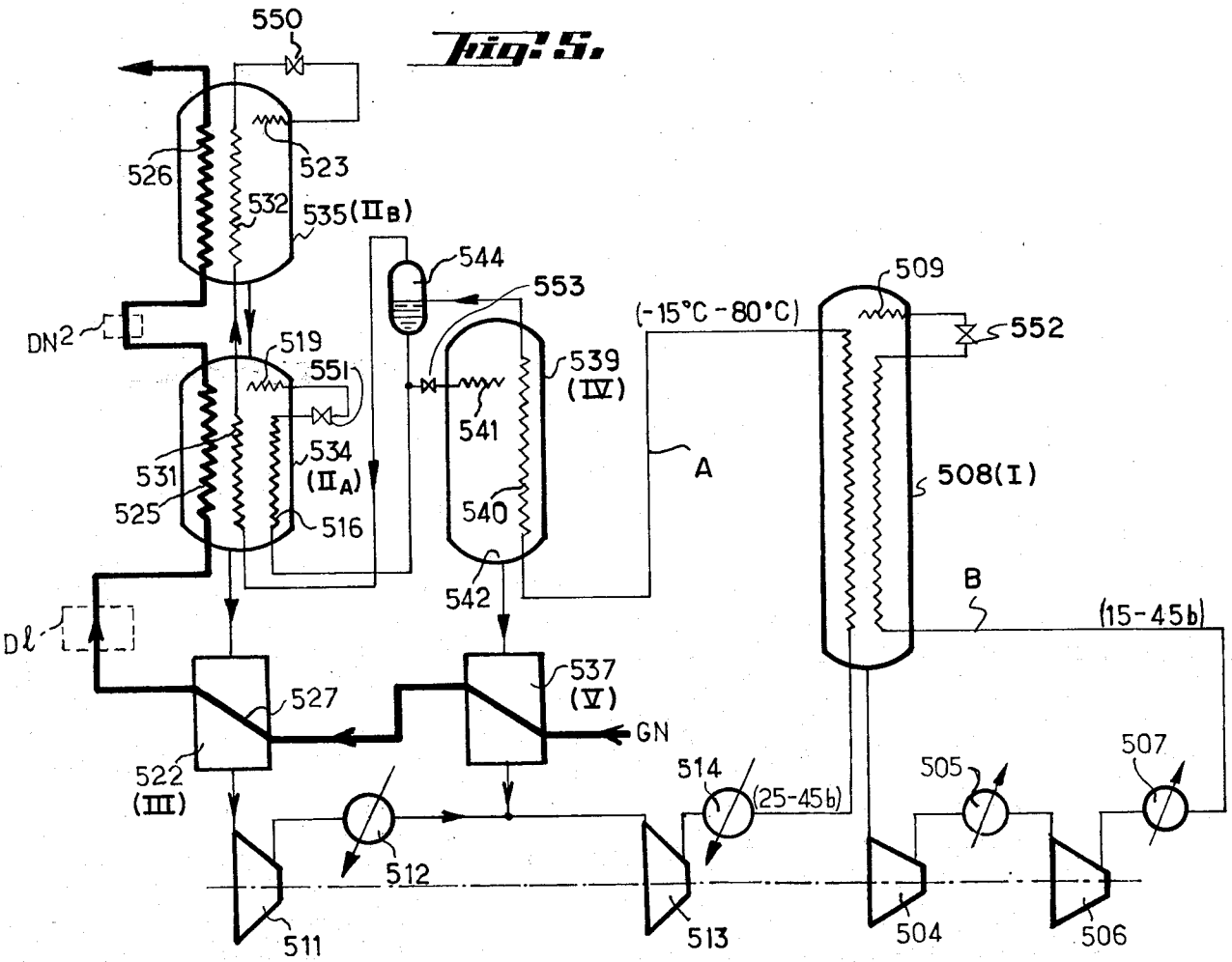

Reference should now be had to the alternative embodiment shown in FIG. 5.

With respect to the plant shown in FIG. 4 there should essentially be noted the omission of the separator 415, the pre-cooling of the natural gas in the multiple-plate exchanger 537 or (V) being performed in exchanging relationship with the sensible heat of a fraction of the expanded and vaporized main refrigerating fluid (A) as shown at 541 in the exchanging column 539 or (IV). This fraction consists of one portion of the liquid phase separated in the separator 544 and serves in addition to pre-cool down to a first level the main refrigerating fluid (A) prior to its separation in the separator 544 and its use in the columns 534 and 535.

In addition to the statements of use referred to previously in relation with the description of FIG. 4, this simplified cycle may more particularly be applied to the use of a centrifugal compressor and makes possible a thorough extraction of the heavy components in particular $C_2$ from the natural gas.

Figure 6:
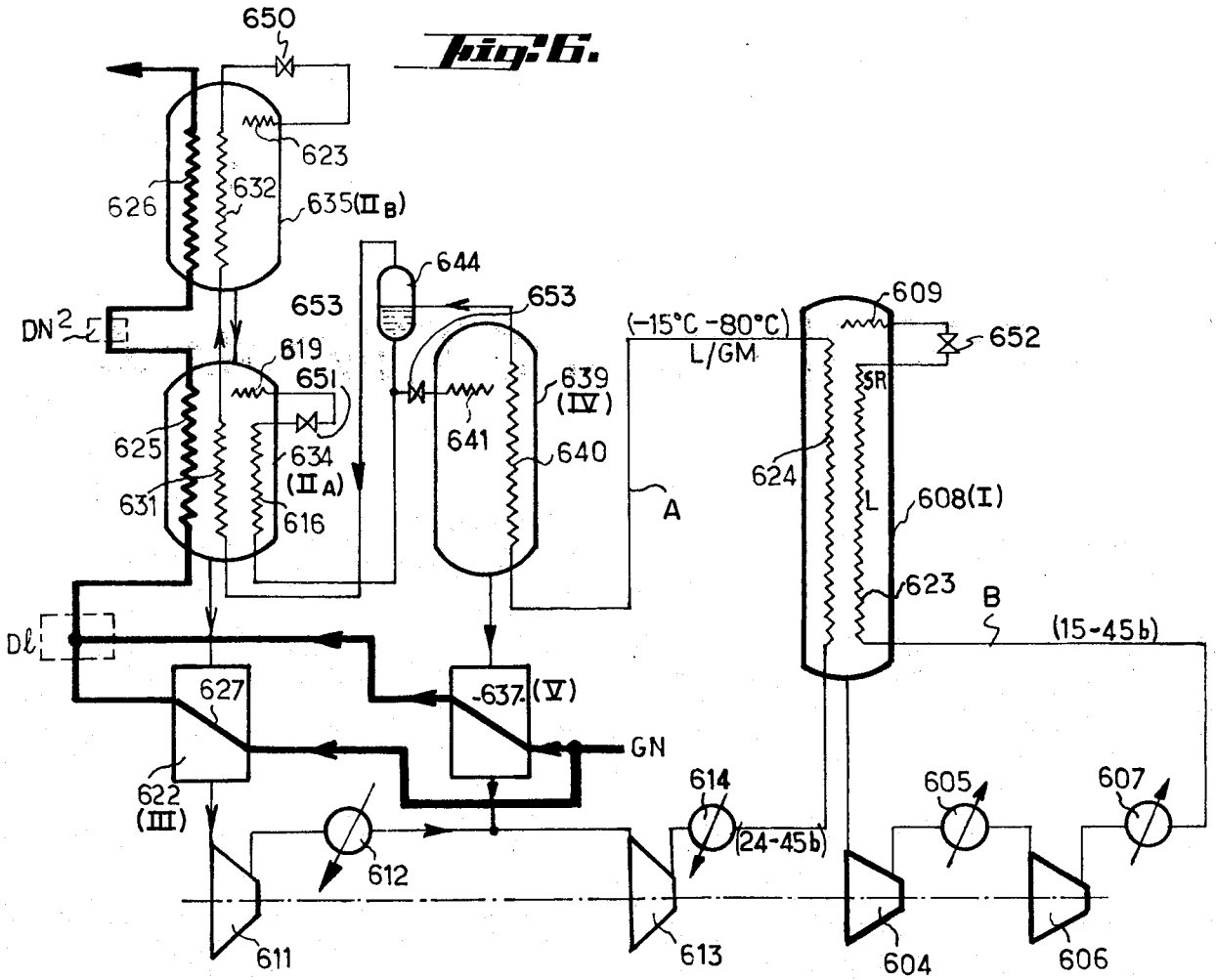

The plant diagrammatically shown in FIG. 6 differs from that illustrated in FIG. 5 in that the natural gas to be liquefied flows through the multiple-plate exchangers 622, 637 or (III), (V) in parallel relationship before being processed in the demethanizer D1 prior to entering the columns 634, 635 or ($II_A$), ($II_B$).

Figure 7:
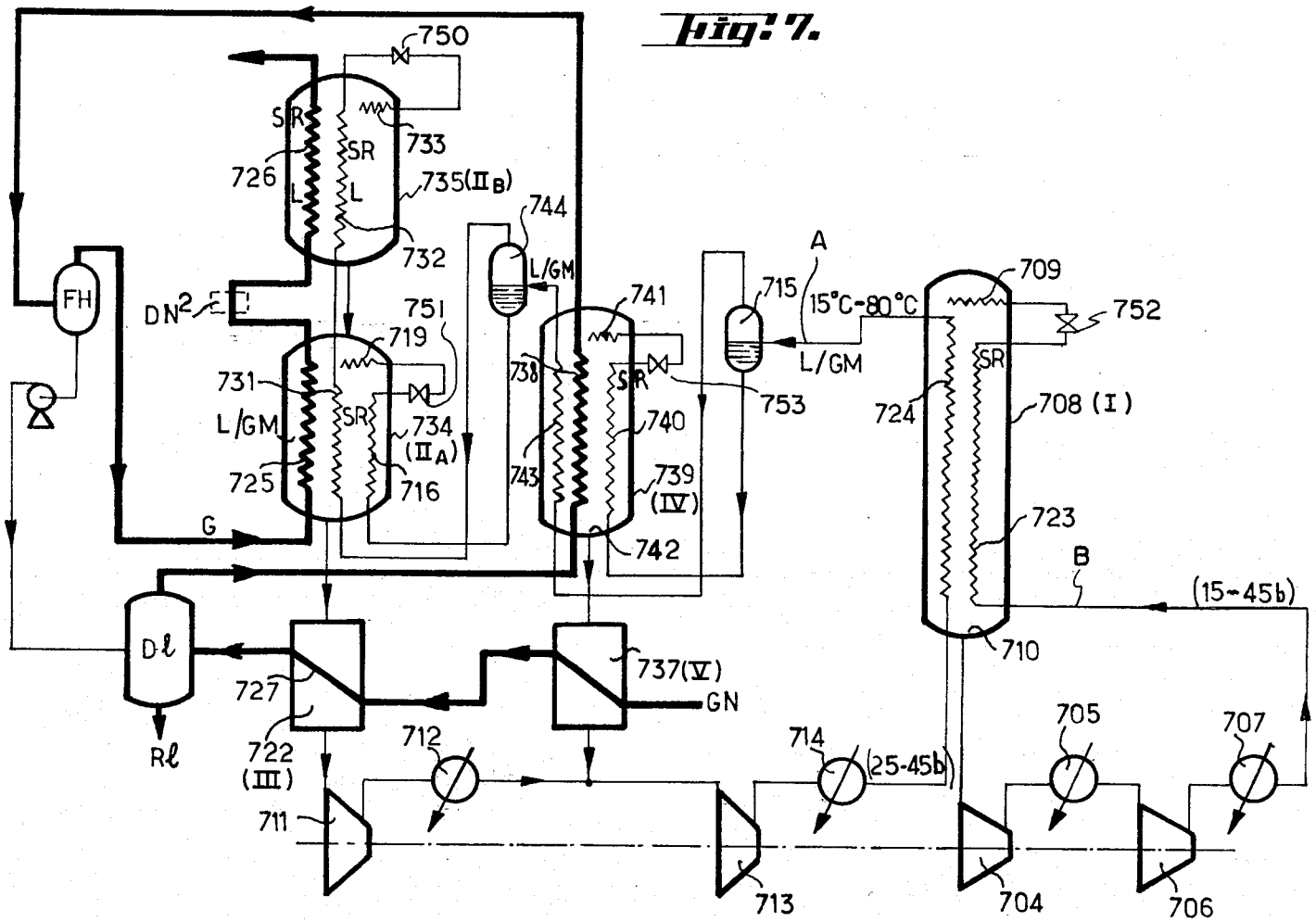

According to the alternative form of embodiment shown in FIG. 7 there is used an operating cycle very similar to that depicted in FIG. 4 but at the egress from the exchanger 722 or (III) the pre-cooled natural gas is processed in a demethanizer D1 and then the natural gas made rid of its heaviest fraction R1 is conveyed to the column 739 or (IV) providing for a more powerful pre-cooling of the natural gas which is then undergoing a flash treatment in a separator FH. When leaving this separator the substantial main part of the natural gas is carried to the liquefaction and sub-cooling columns 734, 735 or ($II_A$), ($II_B$) whereas the heavy fraction is recycled to the demethanizer D1.

Such a treatment of the natural gas prior to its passing through the liquefaction columns 734, 735 may of course also be used in the cycles of FIGS. 5 and 6 and will advantageously be used each time it is desired to recover at least one substantial portion of the heavy hydrocarbons ($C_2$+, $C_3$+, etc.) possibly present initially in the original natural gas.

It should be understood that the invention is not at all limited to the forms of the embodiments and to the examples disclosed which have been given by way of illustration only. In particular the method according to the invention and the plants may be used for the liquefaction of any mixtures of gases having low boiling points and the cycles may be interleaved and carried out differently.

Likewise, as the method is very flexible, a great number of technologies may be used and in particular various types of compressors and of exchangers may be used.

The invention therefore comprises all the technical equivalents of the means described as well as their combinations if same are used within the scope of the appended claims.

What is claimed is:

1. A method of liquefying a natural gas (NG) rich in methane and having a low boiling point, by means of a cold main refrigerant fluid (A) containing at least two hydrocarbons and a substance having a boiling point substantially lower than that of methane, said main refrigerant fluid (A) being precooled by an auxiliary refrigerant fluid (B) containing at least two hydrocarbons having from 1 to 4 carbon atoms, each of said refrigerant fluids being capable of existing in a liquid and a vapor state, said method comprising the steps of:

(1) conveying under pressure a flow of said auxiliary refrigerant fluid (B) along a first closed path of travel (101) which is physically and thermally separated from and independent of the path of travel of said natural gas (NG), said first closed path including at least four successive sections, the first three of which are thermally separated from each other, and processing said auxiliary refrigerant fluid (B) therein by successively:

(a) in the first section (104–106) of said four successive sections, compressing said auxiliary refrigerant fluid (B) from a gaseous state at a low pressure to a high pressure;

(b) in the second section (107) of said four successive sections, precooling, with an outer coolant, said compressed auxiliary refrigerent fluid (B) to liquefy at least a part of said compressed auxiliary refrigerant fluid (B);

(c) in the third section (123) of said four successive sections, said third section extending inside of the fourth section (108) of said four successive sections, successively at least fully liquefying (at L) and subcooling (at SR) said at least partly liquefied auxiliary refrigerant fluid (B) obtained from step (1) (b) as a first confined stream in thermally independent relation to said natural gas;

(d) expanding (at 152) said subcooled liquefied auxiliary refrigerant fluid (B) from step (1) (c), and passing said expanded auxiliary refrigerant fluid (B) through said fourth section (109, 108) and about said third section (123), thereby fully vaporizing said expanded auxiliary refrigerant fluid (B) through indirect heat exchange and in surrounding relationship with and in countercurrent flow with respect to said auxiliary refrigerant fluid (B) flowing in said third section (123), to perform said at least full liquefaction and subcooling of said auxiliary refrigerant fluid (B) before said expansion thereof; and (e) recycling said expanded and vaporized auxiliary refrigerant fluid (B) obtained after said heat exchange in step (1) (d) to said first section (104–106) for compression according to step (1) (a);

(2) conveying under pressure a flow of said main refrigerant fluid (A) along a second closed path of travel (102), said second closed path including at least six successive parts, the first four of which and the last of which are thermally separated from each other, and processing said main refrigerant fluid (A) therein by successively:

(a) in the first part (111–113) of said six successive parts, compressing said main refrigerant fluid (A) from a gaseous state at a low pressure to a high pressure;

(b) in the second part (114) of said six successive parts, precooling, with an outer coolant, said compressed main refrigerant fluid (A);

(c) in the third part (124) of said six successive parts, further precooling and partly liquefying said compressed and precooled main refrigerant fluid (A) obtained from step (2) (b) independently of said natural gas (NG); said compressed and precooled main refrigerant fluid being further precooled and partly liquefied as a first confined flow, said third part extending inside of said fourth section (108) of said first closed path, said precooling and partial liquefying being effected through indirect heat exchange with and in counter-current flow to said expanded and vaporized auxiliary refrigerant fluid (B) flowing in said fourth section (108) in surrounding relation to said third part (124), thereby forming a mixture of liquid and gaseous phases (L/GM) of said main refrigerant fluid (A);

(d) in the fourth part (116, 118) of said six successive parts, successively fully liquefying and subcooling said further precooled and partly liquefied main refrigerant fluid (A) from step (2) (c) as at least one second confined flow in said fourth part, said fourth part extending inside of the fifth part (117) of said six successive parts;

(e) expanding to a lower pressure and (at 150, 120, 151, 119) said subcooled liquefied main refrigerant fluid (A) from each second confined flow (118, 116) and passing said expanded main refrigerant fluid (A) through the fifth part (117) of said six successive parts and about said fourth part (118, 116) thereby fully vaporizing said expanded main refrigerant fluid (A) through indirect heat exchange with and in counter-current flow with respect to said main refrigerant fluid (A) flowing in said fourth part (118, 116), and in surrounding relationship therewith, to perform said full liquefaction and subcooling of said main refrigerant fluid (A) obtained according to step (2) (d) before said expansion thereof;

(f) in the sixth part (122) of said six successive parts, heating said expanded and vaporized main refrigerant fluid (A) obtained after step (2) (e) in thermally independent relation to said auxiliary refrigerant fluid (B) and to steps (2) (d) and (2) (e); and (g) recycling said heated vaporized main refrigerant fluid (A) from step (2) (f) to said first part (111-113) for compression according to step (2) (a);

(3) conveying a continuous flow of said natural gas (NG) under pressure along an open path of travel (103) consisting of at least two successive portions and processing it by successively:

(a) precooling at least a part of said natural gas (NG) as a confined stream in the first portion (127) extending inside of said sixth part (122) of flow of said main refrigerant (A) through indirect heat exchange with said expanded and vaporized main refrigerant fluid (A) flowing in said sixth part (122) in surrounding relationship with said first portion (127), in thermally independent relation to steps (2) (d) and (2) (e);

(b) successively partially and then fully liquefying and subsequently subcooling said precooled natural gas (NG) from step (3) (a) as a confined stream in the second portion (125, 126) of said two successive portions, said second portion extending inside of said fifth part (117) of flow of said main refrigerant (A), through indirect heat exchange with at least said expanded and fully vaporized main refrigerant fluid (A) flowing through said fifth part (117) and about said second portion (125, 126) in counter-current relationship with said precooled natural gas (NG) and in thermally independent relation to said auxiliary refrigerant fluid (B); and (c) recovering said thus liquefied subcooled natural gas (NG) from said second portion (126).

2. The method according to claim 1, wherein said main refrigerant fluid (A) consists essentially of at least some of the lightest components of said natural gas (NG) being liquefied and of at least one component having a boiling point substantially lower than that of the main lighter component of said liquefied natural gas produced.

3. The method according to claim 2, wherein said auxiliary refrigerant fluid (B) consists essentially of at least some of the major components of said main refrigerant fluid (A) and of at least one component having a boiling point substantially higher than that of the least volatile major component of said main refrigerant fluid (A).

4. The method according to claim 1, wherein said main refrigerant fluid (A) comprises at least two hydrocarbons having from 1 to 2 carbon atoms.

5. The method according to claim 4, wherein said main refrigerant fluid (A) contains at least 30 to 55 mol percent of methane and 30 to 65 mol percent of a $C_2$ hydrocarbon.

6. The method according to claim 5, wherein said main refrigerant fluid (A) contains a non-hydrocarbon component having a boiling point lower than that of methane in a molecular proportion ranging from about 1 percent to about 20 percent.

7. The method according to claim 6, wherein said main refrigerant fluid (A) contains at least one $C_3$ hydrocarbon in a molecular proportion of up to 15 percent.

8. The method according to claim 6, wherein the average molecular weight of the hydrocarbons contained in said main refrigerant fluid (A) is between about 20 and about 30.

9. The method according to claim 4, wherein the molecular composition of said auxiliary refrigerant fluid (B) is: 0% to 40% of $C_1$, 0% to 60% of $C_2$, 10% to 60% of $C_3$, 10% to 40% of $C_4$ hydrocarbons.

10. The method according to claim 9, wherein said auxiliary refrigerant fluid (B) contains a $C_5+$ hydrocarbon.

11. The method according to claim 9, wherein the mean molecular weight of the hydrocarbons of said auxiliary refrigerant fluid (B) is between about 30 and about 50.

12. The method according to claim 9, wherein said auxiliary refrigerant fluid (B) is compressed to an effective delivery pressure of from about 15 to about 50 bars, said delivery pressures increasing with the decrease in the desired pre-cooling temperature of said main refrigerant fluid (A), and wherein said vaporized auxiliary refrigerant fluid (B) is recycled to said compression step at an effective pressure which ranges from about 1 to about 6 bars, and which decreases with the decrease in the desired pre-cooling temperature of said main refrigerant fluid (A).

13. The method according to claim 1, wherein said main refrigerant fluid (A) is further precooled and partly liquefied in heat exchange with said auxiliary refrigerant fluid (B) at a temperature between about −15° C. and −80° C.

14. The method according to claim 1, wherein said natural gas entering the process is at a temperature of from about 0° C. to 40° C. and at a pressure of from about 25 bars to about 60 bars and is pre-cooled to a temperature ranging from about −30° C. to about −80° C. while its pressure is in the range of from about 24 bars to 29 bars.

15. The method according to claim 1 wherein:

(a) said mixture of liquid and vapor phases of said main refrigerant fluid (A) from said step (2) (c) is separated (at 115) at least once into a liquid phase and a vapor phase before undergoing said step (2) (d);

(b) said separated liquid and vapor phases are conveyed as two parallel second confined flows in said fourth part, which is thus divided into a first (116) and a second (118) fractional fourth part, both extending inside of said fifth part (117);

(c) the length of said one second confined flow in said first fractional fourth part (116) being fed by said liquid phase being shorter than the respective length of the other second confined flow fed by said vapor phase in said second fractional fourth part (118), and of the confined stream of natural gas (NG) in said second portion (125, 126), each of said second fractional fourth part and said second portion consisting successively of a first length (118, 125) co-extensive with each other and with said first fractional fourth part (116), and of a second length (118, 126) co-extensive with each other and extending beyond the downstream end of said first fractional fourth part;

(d) the one second confined flow in said first fractional fourth part (116) which is fed by said liquid phase being subcooled and then expanded (at 151), at the downstream end thereof;

(e) said other second confined flow which is fed by said vapor phase in said second fractional fourth part (118), being successively liquefied and subcooled and then expanded (at 150) at the downstream end thereof;

(f) flowing said expanded (at 120) main refrigerant fluid (A), in said fifth part (117) about said second lengths of said second portion (126) and of said second fractional fourth part (118), in counter-current relation to and in indirect heat exchange with said at least partly liquefied natural gas and with said other second confined flow of main refrigerant fluid (A) for fully liquefying and subcooling them and then joining said fluid with the expanded and vaporized main refrigerant fluid (A) formed from said one second confined flow (at 119) to flow about said first lengths of said second portion (125) and of said second fractional fourth part (118), and about said first fractional fourth part (116), thereby fully vaporizing said expanded main refrigerant fluid (A) in countercurrent relation to and through indirect heat exchange with said precooled natural gas (NG) to at least partly liquefy same and with said other second confined stream fed by said vapor phase to cool it, and with said liquid phase to subcool it.

16. The method according to claim 15 wherein:

(a) said fifth part consists of two successive fractions (434, 435);

(b) one fraction (434) containing said first fractional fourth part (416) and said first lengths (431, 425) of said second fractional fourth part and of said second portion; and (c) the other fraction (435) containing both second lengths (432, 426) of said second fractional fourth part and of said second portion.

17. The method according to claim 16, wherein:

(a) said partly liquefied main refrigerant fluid (A) from step (2) (c) is additionally cooled as at least one further confined flow independently of said auxiliary refrigerant fluid (B) in at least one intermediate part (440, 443, 540) of its path of travel (102) before at least one portion thereof undergoes said one phase separation step (at 444, 554);

(b) at least one portion of a liquid phase of said main refrigerant fluid (A) is expanded (at 453, 553) near the downstream end of said intermediate part and passed through one branch part (439, 539) of its path of travel (102) enclosing each intermediate part, thereby fully vaporizing said expanded main refrigerant fluid (A) in counter-current indirect heat exchanging relationship with said further confined flow for additionally cooling same;

(c) recovering the thus warmed vaporized portion of said main refrigerant fluid (A) at the downstream end (442, 542) of said one branch part (439, 539) and further heating it by passing same through another branch part (437, 537) of its path of travel (102) communicating with said one branch part (439, 539); and recycling said heated vaporized portion from said other branch part (437, 537) to a second stage compression (at 413);

(d) precooling at least one portion of said natural gas (NG) entering the process cycle by passing it as a confined stream through a preliminary portion of its path of travel (103), extending inside of said other branch part (437, 537) in indirect heat exchange with said expanded and vaporized portion of said main refrigerant fluid (A) flowing therethrough.

18. The method according to claim 17, wherein all of said natural gas (NG) entering the process is successively pre-cooled twice by flowing as a confined stream (427, 527) at first through said preliminary portion and then through said first portion of its path of travel (103).

19. The method according to claim 17, wherein said natural gas (NG) entering said process is divided into two confined partial streams forming said preliminary and first portions (627) of its path of travel and flowing in parallel, the one through said sixth part (622) and the other through said other branch part (637) of the path of travel (102) of said main refrigerant fluid (A), both streams meeting together downstream of said sixth part and said other branch part.

20. The method according to claim 17, wherein all of the main refrigerant fluid (A) in the mixed liquid-gaseous phase issuing from said third part (524, 624) of its path of travel (102) is directly subjected to said additional cooling step in said intermediate part (540, 640) to thereafter undergo said phase separation (at 544, 644), and a fraction of its separated liquid phase is taken therefrom and expanded (at 553; 653) and passed into said one branch part (539, 639) where it is fully vaporized in counter-current heat exchanging relationship with said mixed phase for additionally cooling same.

21. The method according to claim 17, wherein:

(a) all of said main refrigerant fluid (A) in the mixed liquid-gaseous phase (L/GM) from said step (2) (c), before being additionally cooled, is separated (at 415, 715) into a liquid phase and a vapor phase which are conveyed in parallel as two further confined flows, respectively, in two intermediate parts (440, 443, 740, 743);

(b) said liquid phase is passed as one further confined flow in one intermediate part (440, 740) through said one branch part (439, 739) to be subcooled (at SR) therein, and is then expanded (at 453, 753) at the downstream end of said one intermediate part (440, 740) within said one branch part (439, 739) and passed therethrough about said two intermediate parts in indirect counter-current heat exchange with said one further confined flow forming said liquid phase for subcooling same whereby said expanded liquid phase is fully vaporized;

(c) said vapor phase is passed as another further confined flow in another intermediate part (443, 743) through said one branch part (439, 739) in counter-current relation to said expanded and vaporized liquid phase and in indirect heat exchange with said liquid and vaporized phases, whereby said vapor phase is partially liquefied and is thereafter subjected to said phase separation step (at 444, 744).

22. The method according to claim 21, wherein at least one of said outer coolants is air.

23. The method according to claim 17, wherein:

(a) said precooled natural gas (NG), before being at least partially liquefied in said second portion (425, 525, 625, 725) of its path of travel (103), is successively demethanized (at D1) to remove at least the heaviest components therefrom (at R1) and then subjected to a separating step through flash treatment (at FH) to remove the heavy fractions ($C_2$, $C_3$, etc.) therefrom which are recycled to said demethanizing step; and (b) said natural gas (NG), after having been partially liquefied in said first length (425, 525, 625, 725) of said second portion, is denitrogenized (at $DN^2$) before being fully liquefied in said second length (426, 526, 626, 726) of said second portion.

24. The method according to claim 23, wherein said purified precooled natural gas (NG) from said demethanizing step (D1) is further precooled by passing as an additional confined stream in an additional portion (738) of its path of travel (103) through said one branch part (440, 540, 640, 740) in countercurrent relation to said vaporized portion of said main refrigerant fluid (A) therein and in indirect heat exchange with the latter, before undergoing said separating step through flash treatment (at FH).

25. The method according to claim 1, wherein said mixture (L/GM) of liquid and vapor phases of said main refrigerant fluid (A) from step (2) (c) is directly subjected to step (2) (d) as one single second confined flow in said fourth part (228) which is co-extensive with said second portion (230) inside of said fifth part (217).

26. The method according to claim 25, wherein:

(a) said single second confined flow of said main refrigerant fluid (A) in said fourth part is successively further cooled in a first length (331) of said fourth part in co-extension with a first length (325) of said second portion within a first fraction (334) of said fifth part and then fully liquefied and subcooled in a second length (332) of said fourth part in co-extension with a second length (326) of said second portion with a second fraction (335) of said fifth part communicating with said first fraction thereof;

(b) said thus subcooled liquefied main refrigerant fluid (A) is expanded (at 350), at the downstream end of said second confined flow and passed successively through said second fraction (335) of said fifth part about said second lengths (326, 332) of said second portion and said fourth part, respectively, thereby fully vaporizing said expanded main refrigerant fluid (A) in counter-current indirect heat exchanging relationship with said confined stream of natural gas and said second confined flow of main refrigerant fluid (A), therein to fully liquefy and subcool them and then through said first fraction (334) of said fifth part about said first lengths (325, 331) of said second portion and said fourth part, respectively, in counter-current indirect heat exchanging relationship with said confined stream of natural gas and said mixture of liquid and vapor phases of main refrigerant fluid (A) therein to at least partially liquefy the former and further cool the latter.

27. The method according to claim 1, wherein said precooled natural gas (NG) is demethanized (at D1) to remove heavy components therefrom before being at least partially liquefied in said second portion (125) of its path of travel (103).

28. The method according to claim 27, wherein said natural gas (NG), after having been partially liquefied in a first length (125) of said second portion, is denitrogenized (at $DN^2$) before being fully liquefied in a second length (126) of said second portion.

29. The method according to claim 1, wherein at least one of said outer coolants is water.

30. An apparatus for liquefying a natural gas rich in methane, having a low boiling point, consisting of:

(1) a first closed cooling circuit (101) having an auxiliary refrigerant fluid (B) flowing therethrough and successively comprising:

(a) first compressor means (104–106) having inlet means and outlet means;

(b) first precooler means (107) having:

(i) first passage-way means for said auxiliary refrigerant fluid (B) with first ingress means connected to said outlet means of said first compressor means (106) and with first egress means; and, (ii) second passage-way means for a first outer coolant;

(c) first heat exchange column means (I) including:

(i) first casing means (108); and (ii) first duct means (123) extending from bottom to top within and through said first casing means (108) and having its bottom end connected to said first egress means of said first precooler means (107), and its top end connected in series successively to (iii) first expansion valve means (152) and to (iv) first vaporization-promoting means (109) opening downwards into said casing means (108); and (v) the bottom end (110) of said first casing means (108) being connected to said inlet means of said first compressor means (104);

(2) a second closed cooling circuit (102) having a main refrigerant fluid (A) flowing therethrough and successively comprising:

(a) second compressor means (111–113) having inlet means and outlet means;

(b) second precooler means (114) having (i) third passage-way means for said main refrigerant fluid (A) with second ingress means connected to said outlet means of said second compressor means (113) and with second egress means; and (ii) fourth passage-way means for a second outer coolant;

(c) second duct means (124) extending from bottom to top inside of and through said first casing means (108) of said first heat exchange column means (I) in co-extensive relationship with said first duct means (123) and having its bottom end connected to said second egress means of said second precooler means (114);

(d) second heat exchange column means (II) physically and thermally separated from and independent of said first closed cooling circuit (101) and including:

(i) second casing means (117) and
(ii) third duct means (116, 118), at least one part of which extends from end to end of said second casing means (117) and having the downstream upper end thereof connected successively to
(iii) second expansion valve means (151, 150) and to
(iv) second vaporization-promoting means (119–120) opening downwards into said second casing means (117);

(e) first heat exchanger means (III) physically and thermally separated from and independent of said first closed cooling circuit (101) and including first shell means (122) having first intake means connected to the bottom end (121) of said second casing means (117) and first eduction means connected to said inlet means of said second compressor means (111);

(3) an open circuit having said natural gas (NG) flowing therethrough, physically and thermally separated from an independent of said first closed circuit, with an upstream inlet end (103) and a downstream outlet end, and successively comprising:
(a) fourth duct means (127) extending at least in part through and within said first shell means (122) of said third heat exchanger means (III) and having its upstream end connected to said upstream inlet end (103);
(b) fifth duct means (125, 126) extending from bottom to top inside of and through said second casing means (117) of said second heat exchange column means (II) in co-extensive relationship with said third duct means (116, 118) and having its lower end connected to the downstream end of said fourth duct means (127) and its upper end connected to said downwstream outlet end of said open circuit.

31. The apparatus according to claim 30, further comprising:
(a) first phase separator means (115) having a liquid phase holding space, a vapor phase holding space and a mixed liquid-vapor phase inlet connected to the downstream upper end of said second duct means (124);
(b) said third duct means consisting of two co-extensive third ducts (116, 118) of differing lengths,
(c) the shorter third duct (116) located in the lower portion of said second casing means (117) of said second heat exchange column means (II) and having its bottom upstream end connected to said liquid phase holding space of said first phase separator means (115), and having its downstream upper end connected in series successively to one (151) of said second expansion valve means and one (119) of said second vaporization means;
(d) the longer third duct (118) extending from end to end of said second casing means (117) and having its upstream lower end connected to said vapor phase holding space of said first phase separator means, and having its downstream upper end successively connected in series to the other (150) of said second expansion valve means and to the other (120) of said second vaporization-promoting means.

32. The apparatus according to claim 31, wherein said second heat exchange column means (II) consists of two successive second heat exchange units (IIA, IIB) having two successive interconnected second casings (434, 435), wherein:
(a) the first successive second heat exchange unit (IIA) having a second casing (434) containing said shorter third duct means (416) together with at least its associated one second vaporization means (419), a lower section (431) of said longer third duct means, and a lower section (425) of said fifth duct means; and
(b) the second successive second heat exchange unit (IIB) having another second casing (435) containing the upper section (432) of said longer third duct means together with at least its corresponding other second vaporization-promoting means (433), and the upper section (426) of said fifth duct means which are connected to said lower sections of said longer third duct and of said fifth duct means (431, 425) respectively.

33. The apparatus according to claim 31, further comprising:
(a) third heat exchange column means (IV) physically and thermally separated from and independent of said first closed cooling circuit (101) and including:
(i) third casing means (439, 539) and intermediate duct means (440, 443, 540) extending from bottom to top inside of and through said third casing means and having the upstream lower end thereof connected to the downstream upper end of said second duct means (424, 524) whereas the downstream upper end of at least one part of said intermediate duct means is connected to said mixed liquid-vapor phase inlet of said first phase separator means (444, 544); and
(ii) third vaporization-promoting means (441, 541) opening downwards into the top of said third casing means (439, 539) and connected upstream through third expansion valve means (453, 553) to conduit means carrying a liquid phase of at least one portion of said main refrigerant fluid (A);
(b) second heat exchanger means (V) physically and thermally separated from and independent of said first closed circuit (101) and including second shell means (437, 537) having second intake means connected to the bottom end (412, 512) of said third casing means (439, 539) and second eduction means;
(c) said second compressor means consisting of at least two successive interconnected low pressure and high pressure compression stages (411, 413, 511, 513) and the suction side of said high pressure compression stage (413, 513) being connected to said second eduction means; and
(d) said fourth duct means extending at least in part through and within said second shell means of said second heat exchange means (V).

34. The apparatus according to claim 33, wherein said fourth duct means consist of two successive upstream and downstream portions connected in series to each other, said upstream portion extending through said second heat exchanger means (V) whereas said downstream portion (427, 527, 727) extends through said first heat exchanger means (III).

35. The apparatus according to claim 33, wherein said fourth duct means consist of two branch ducts connected in parallel, wherein one branch duct (627) extends through said first heat exchanger means (III) and the other branch duct extends through said second heat exchanger means (V), both branch ducts joining together at their downstream ends, respectively, after said two first and second heat exchanger means.

36. The apparatus according to claim 33, wherein said intermediate duct means consist of one single intermediate duct (540, 640) directly connected between said first phase separator means (544, 644) and said second duct means (524, 624), whereas said liquid phase holding space of said first phase separator means is connected through a branch line successively to said third expansion valve means (551, 651) and to said third vaporization-promoting means (541, 641).

37. The apparatus according to claim 33, further comprising:

(a) second phase separator means (415, 715) having a mixed liquid-vapor phase inlet connected to said downstream upper end of said second duct means (424, 724), a liquid phase collecting space and a vapor phase collecting space;

(b) said intermediate duct means consist of two co-extensive intermediate ducts, wherein one intermediate duct (440, 740) has its upstream lower end connected to said liquid phase collecting space and its downstream upper end connected successively to said third expansion valve means (453, 753) and said third vaporization-promoting means (441; 741), and the other intermediate duct (443, 743) has its upstream lower end connected to said vapor phase collecting space and its downstream upper end connected to said mixed liquid-vapor phase inlet of said first separator means (444, 744).

38. The apparatus according to claim 33, wherein said open circuit further comprises:

(a) demethanizer means (D1) connected between said fourth duct means (427, 527, 627, 727) and fifth duct means (425, 525, 625, 725);

(b) flash treatment separator means (FH) connected between said demethanizer means (D1) and said fifth duct means (425, 525, 625, 725), and having a heavy fraction receiving space connected to said demethanizer means (D1); and (c) denitrogenizer means ($DN^2$) connected between a lower section (425, 525, 625, 725) and an upper section (426, 526, 626, 726) of said fifth duct means and outside of said second heat exchange column means (II).

39. The apparatus according to claim 38, wherein said open circuit further comprises additional duct means (738) extending upwards within and through said third casing means (739) of said third heat exchange column means (IV) in co-extensive relation to said intermediate duct means (740, 743) therein and connected between said demethanizer means (D1) and said flash treatment separator means (FH).

40. The apparatus according to claim 33, wherein said duct means extending within said first, second and third heat exchange column means (I, II, IV) are of the coiled pipe type whereas said first and second heat exchanger means (III, V) are of the plate type.

41. The apparatus according to claim 30, wherein said third duct means consists of one single third duct (228, 331, 332), the upstream bottom end of which is directly connected to the downstream upper end of said second duct means (224, 324).

42. The apparatus according to claim 41, wherein said second heat exchange column means (II) consists of two successive second heat exchange units (IIA, IIB) having two successive interconnected second casings (334, 335), wherein:

(a) the first said successive second heat exchange unit (IIA) has a lower second casing (334) containing a lower section (331) of said single third duct and a lower section (325) of said fifth duct means, (b) the second said successive second heat exchange unit (IIB) has its upper second casing (335) containing an upper section (332) of said single third duct together with its corresponding second vaporization-promoting means (331) and an upper section (326) of said fifth duct means connected to said lower sections of said single third duct and of said fifth duct means, respectively.

43. The apparatus according to claim 30, further comprising demethanizer means (D1) connected between said fourth and fifth duct means.

44. The apparatus according to claim 43, further comprising denitrogenizer means ($DN^2$) connected between two lower and upper sections, respectively, of said fifth duct means and outside of said second heat exchange column means (II).

45. The apparatus according to claim 30, wherein said duct means extending within said first and second heat exchange column means (I, II) are of the coiled pipe type whereas said first heat exchanger means (III) is of the plate type.

* * * * *

UNITED STATES PATENT AND TRADEMARK OFFICE

CERTIFICATE OF CORRECTION

PATENT NO. : 4,274,849

DATED : June 23, 1981

INVENTOR(S) : Christian Garier and Henri Paradowski

It is certified that error appears in the above—identified patent and that said Letters Patent is hereby corrected as shown below:

Column 1, line 12, "with" should read -- having a --.

Column 1, line 26, after "recycled" insert -- to --.

Column 1, line 55, "singlecompressor" should read -- single compressor --.

Column 3, line 31, "compenste" should read -- compensate --.

Column 3, line 48, "precooling" should read -- pre-cooling --.

Column 3, line 62, "course" should read -- source --.

Column 4, line 22, "precooling" should read -- pre-cooling --.

Column 5, line 8, "disbributed" should read -- distributed --.

Column 5, line 59, "expansionvaporization" should read -- expansion-vaporization --.

UNITED STATES PATENT AND TRADEMARK OFFICE

CERTIFICATE OF CORRECTION

PATENT NO. : 4,274,849

DATED : June 23, 1981

INVENTOR(S) : Christian Garier and Henri Paradowski

It is certified that error appears in the above—identified patent and that said Letters Patent is hereby corrected as shown below:

Column 6, line 67, "subcooling" should read -- sub-cooling --.

Column 7, line 12, "22-23" should read -- 22-28 --.

Column 7, line 46, "0-10" should read -- 0-40 --.

Column 9, lines 31-32, "colunm" should read -- column --.

Column 9, line 62, after "(IV)", insert -- , --.

Column 10, line 36, after "possible" insert -- to --.

Column 12, line 3, "refrigerent" should read -- refrigerant --.

Column 15, line 44, after "it", insert -- (Figures 1 and 4 to 7) --.

Column 19, line 22, "an" should read -- and --.

UNITED STATES PATENT AND TRADEMARK OFFICE

CERTIFICATE OF CORRECTION

PATENT NO. : 4,274,849

DATED : June 23, 1981

INVENTOR(S) : Christian Garier and Henri Paradowski

It is certified that error appears in the above—identified patent and that said Letters Patent is hereby corrected as shown below:

Column 19, line 37, "downwstream" should read -- downstream --.

Signed and Sealed this

*Twenty-second* Day of *September 1981*

[SEAL]

*Attest:*

GERALD J. MOSSINGHOFF

*Attesting Officer*

*Commissioner of Patents and Trademarks*